United States Patent [19]

Bareis et al.

[11] 4,135,446

[45] Jan. 23, 1979

[54] PRESS ARRANGEMENT

[75] Inventors: Alfred Bareis, Uhingen; Reinhard Braun, Eislingen, both of Fed. Rep. of Germany

[73] Assignee: L. Schuler GmbH, Fed. Rep. of Germany

[21] Appl. No.: 797,428

[22] Filed: May 16, 1977

[30] Foreign Application Priority Data

May 15, 1976 [DE] Fed. Rep. of Germany ..... 2621727

[51] Int. Cl.[2] ..... B30B 1/26

[52] U.S. Cl. ..... 100/257; 83/530

[58] Field of Search ..... 100/257, 282; 72/432, 72/454; 83/527, 530; 74/583, 586

[56] References Cited

U.S. PATENT DOCUMENTS 3,233,441 2/1966 Dunlap ..... 100/257

FOREIGN PATENT DOCUMENTS 2424783 12/1975 Fed. Rep. of Germany ..... 100/257

39755 11/1971 Japan ..... 100/257

33111 8/1972 Japan ..... 100/257

*Primary Examiner*—Billy J. Wilhite

*Attorney, Agent, or Firm*—Craig & Antonelli

[57] ABSTRACT

A press arrangement which includes a press table, a punch and an adjusting arrangement for selectively adjusting the distance between the press table and punch. A pressure space is provided in the punch which selectively communicates with a pressure medium supply so as to load and relieve the pressure space. A piston is floatingly disposed in the pressure space and cooperates with an element of the adjusting arrangement so as to create a constantly-acting or permanently-acting tension on the adjusting arrangement when the pressure space is filled with a pressure medium.

8 Claims, 3 Drawing Figures

Figure 1:
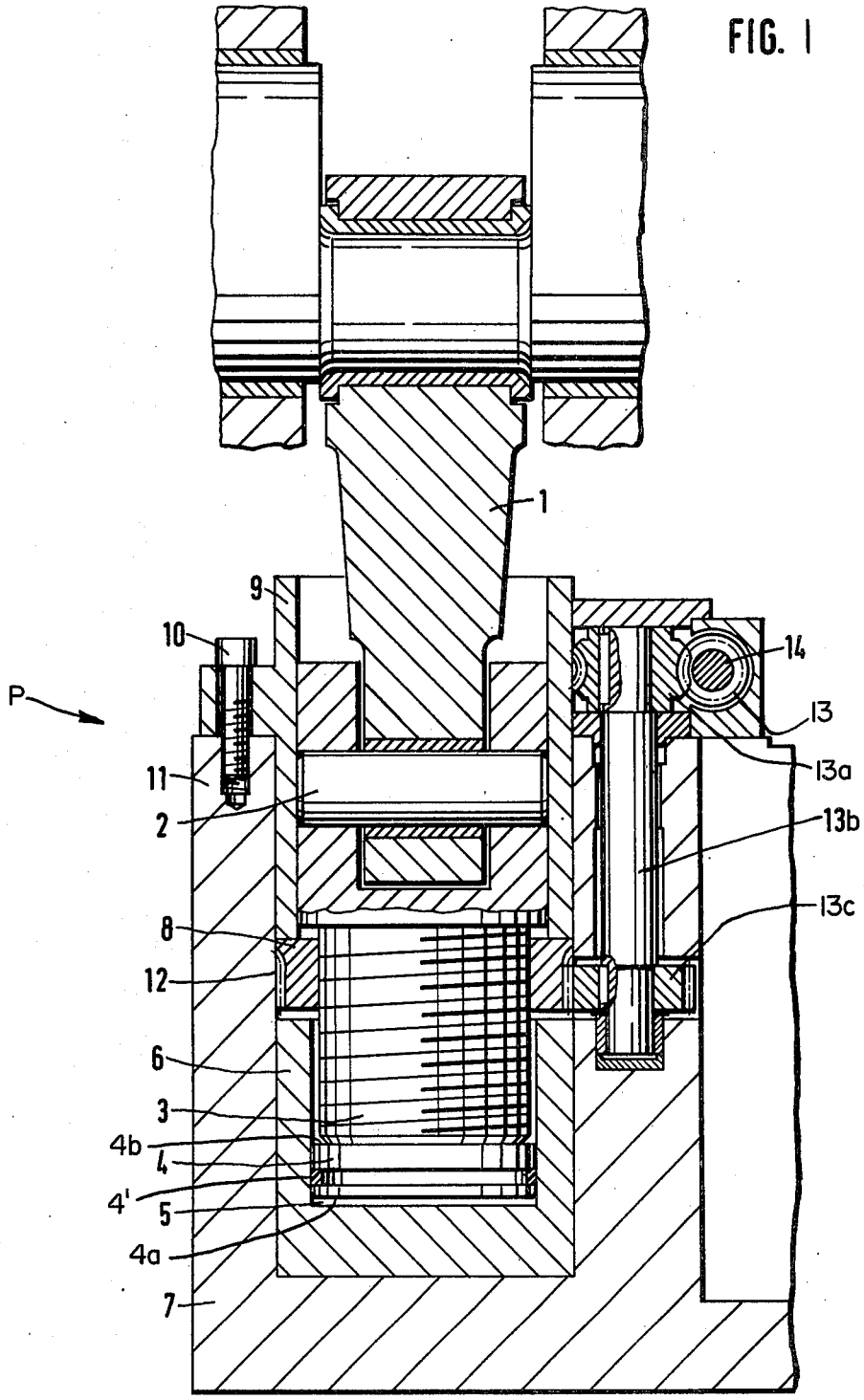

1
9
10
P
11
2
8
12
6
3
4b
4
4'
5
4a
7
14
13
13a
13b
13c 1
9
10
P
2
8
12
11
3
6
4b
5
4
4a
15
7
16

PRESS ARRANGEMENT

The present invention relates to a press arrangement and, more particularly, to a press arrangement having mechanical drive elements, a punch and a press table spaced from the table with an adjustable mounting arrangement being provided at the drive elements for selectively varying the spacing between the table and the punch and with a pressure space arranged in a path of force between respective articulations of a drive element and the punch so as to form a pressure cushion which is selectively filled and relieved of a pressure medium.

Presses have been proposed, for example, in Offenlegungsschrift 1,627,954 wherein a pressure space is filled with a pressure medium so as to form a pressure cushion in the punch. To eliminate a tension in the force path of the punch occasioned by the seizure of a punch and to allow for a release of a seized punch, a screw arrangement is provided on a drive element articulated at the punch, which screw arrangement serves to vary a distance between the punch and press table. To avoid the offset resulting from the play in the threads of the screw arrangement, at the point of articulation of the drive element and the punch, the screw arrangement is tensionable only at that point by, for example, a lock nut.

One disadvantage of the above-proposed press resides in the fact that a special operation is required with the tensioning of each adjustment of the screw arrangement. Moreover, there exists the possibility of the tensioning of the thread of the screw arrangement loosening due to the forces which occur in the screw arrangement with each work or press stroke.

In Auslegeschrift 1,138,321 and U.S. Pat. No. 3,233,441, presses of another type are disclosed wherein a screw arrangement is constructed from a rotatable drivable threaded nut that is axially fixed in a punch with a non-rotatable bolt axially guided in the punch cooperating with the nut and with one end of the bolt being articulated to a press drive element. Additionally, tensioning means for the screw arrangement are provided and constructed, for example, as a counter-pressure screw or a lock nut. However, a disadvantage of these proposed constructions resides in the fact that a special actuating operation is required with each adjustment of the screw arrangement and also there exists the possibility of a loosening of the tensioning means due to the forces that are effective on the screw arrangement during operating cycles of the presses.

The aim underlying the present invention essentially resides in providing a press having mechanical drive elements in which a constantly-acting or permanently-acting tensioning of the screw arrangement is obtained by utilizing a relievable pressure space or pressure cushion which is generally necessary to release a seized punch.

According to advantageous features of the present invention, a screw arrangement for varying the distance between the punch and press table is provided which includes a rotatable and drivable threaded nut axially fixed in the punch and a bolt means cooperating therewith which is non-rotatable but axially guided in the punch. One end of the bolt means is pivotally connected to a drive element of the press with the other end thereof cooperating with a piston defining a pressure space forming a pressure cushion.

By virtue of the above-noted features of the present invention, a press arrangement is provided wherein, during an operation of the press arrangement, a pretensioning of the pressure medium to the relievable pressure space may be adjusted whereby a transfer of a force by way of the pressure cushion in the pressure space is greater than a maximum force to be applied by the drive elements of the press arrangement. In a pretension state, in operation of the press arrangement, a constantly-acting or permanently-acting tension on the screw arrangement is created so as to compensate for any play in the thread of the screw arrangement.

Additionally, by virtue of the provision of the pressure space and pressure cushion therein which can be relieved or unloaded, in an unloaded or relieved state, a release of a seized punch is readily possible. Moreover, an unloading or relieving of the pressure space can be effected if the screw arrangement is to be adjusted to, for example, adjust or change the distance between the punch and press table.

According to another advantageous feature of the present invention, the piston floats between the pressure cushion in the pressure space and the end of the bolt means so that the floating piston is acted upon by the pressure medium charge of the pressure cushion with the force of the pressure cushion being applied directly to the end of the bolt means by the floating piston.

Accordingly, it is an object of the present invention to provide a press arrangement which avoids by simple means the aforementioned disadvantages and shortcomings encountered in the prior art.

A further object of the present invention resides in providing a press arrangement which enables a constantly-acting or permanently-acting tension on an adjusting arrangement of the punch and press table.

Yet another object of the present invention resides in providing a press arrangement which functions reliably under all operating conditions.

A still further object of the present invention resides in providing a press arrangement which compensates for any play in the adjusting arrangement of the punch and press table and which permits adjusting of the adjusting arrangement in a relatively simple manner.

Figure 2:
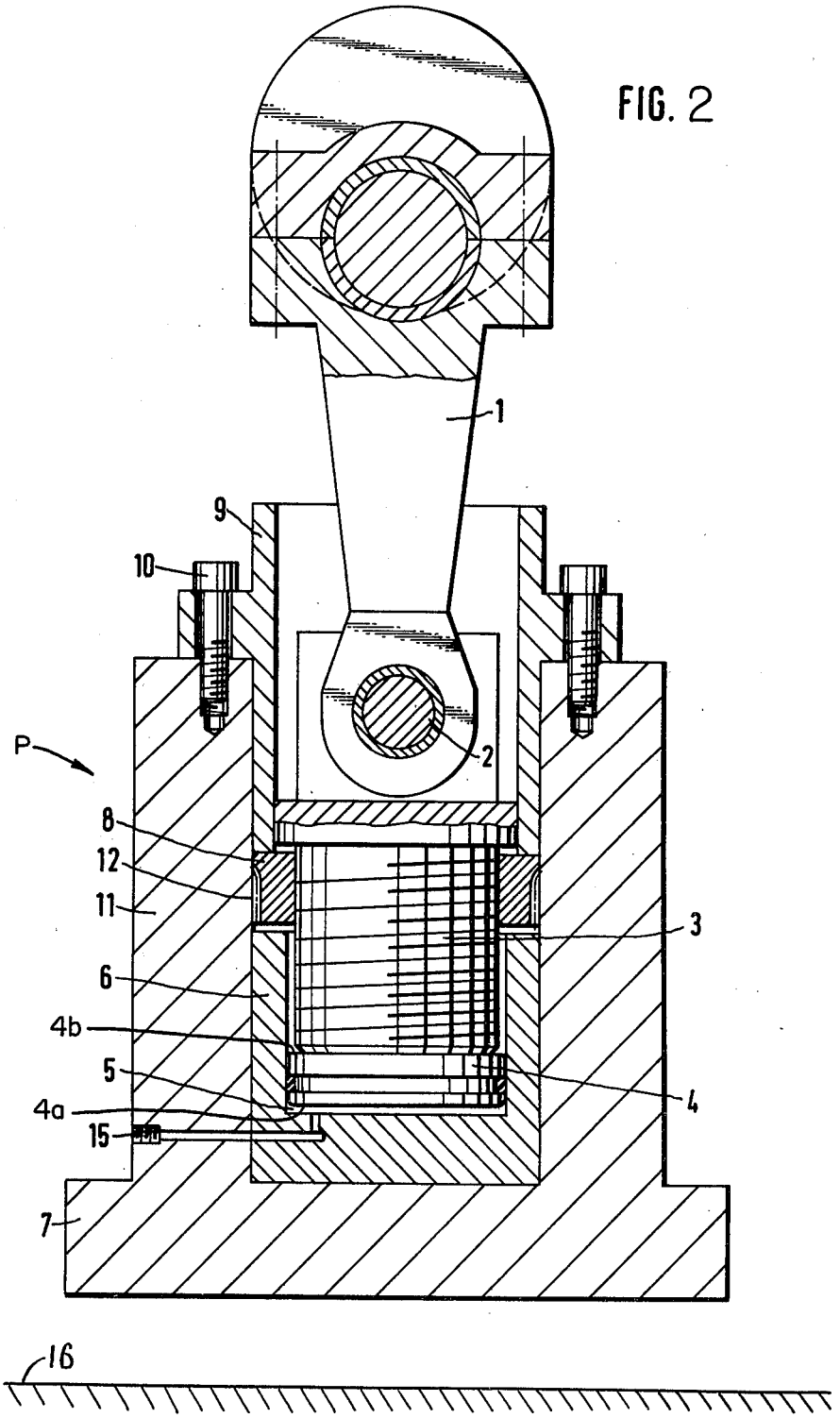
Figure 3:
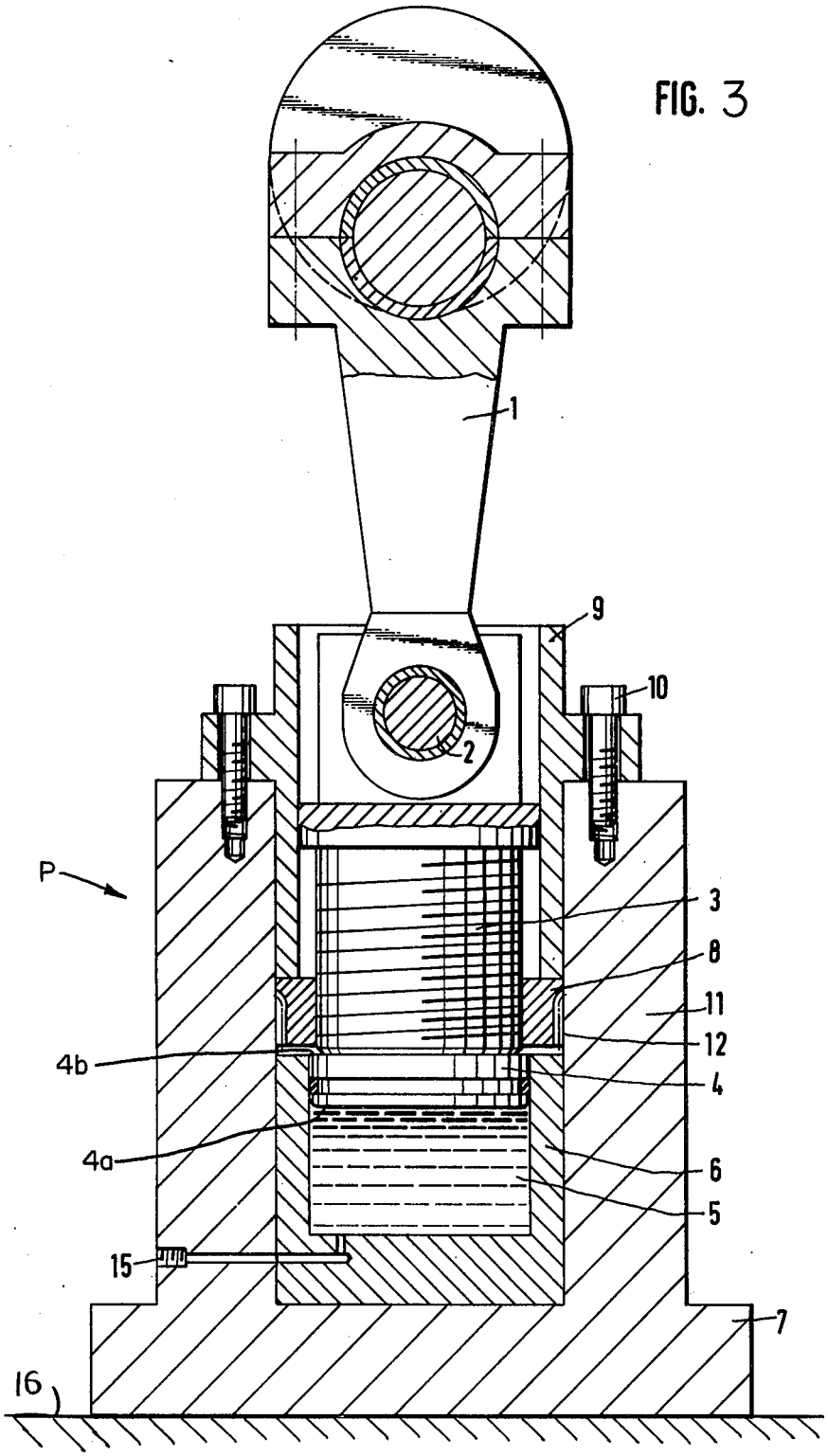

These and other objects, features and advantages of the present invention will become apparent from the following description when taken in connection with the accompanying drawings which show, for the purposes of illustration only, one embodiment in accordance with the present invention, and wherein:

FIG. 1 is a partially schematic longitudinal cross-sectional view of a press arrangement in accordance with the present invention; and FIGS. 2 and 3 are vertical cross-sectional views of the press arrangement of FIG. 1 illustrating maximum and minimum separation of a punch from a press table.

Referring now to the drawings wherein like reference numerals are used throughout the various views to designate like parts and, more particularly, to FIG. 1, according to this figure, a press arrangement is provided which includes a punch generally designated by the reference character P having spaced punch walls 11 and a bottom wall 7 defining an opening or chamber for accommodating a pot-shaped cylinder 6, seated on the bottom wall 7, in which cylinder is slidably received a piston 4. A conventional sealing means 4' is provided at the piston 4 to prevent a leakage of a pressure medium supplied from a suitable pressure medium source (not shown) to a pressure space 5 defined between a lower surface 4*a* of the piston 4 and the pot-shaped cylinder 6.

A sleeve 9 is received in the punch P and is fixedly secured thereto by suitable fastening means such as, for example, bolts or screws 10. A threaded bolt 3 is received in the punch P and is pivotally connected to a drive element, for example, a piston rod 1, by a bolt or pin 2 so as to be non-rotatable with respect to the punch P and axially movable with respect to the sleeve 9 and punch P.

A nut 8 is axially fixed and rotatably mounted in the punch P between the sleeve 9 and pot-shaped cylinder 6. The nut 8 cooperates with the threads on the threaded bolt 3 and is provided on its outer periphery with an external toothing 12. The piston 4 floats in the pressure space 5 and, upon a pressure medium being supplied to the pressure space 5, the pressure medium acts upon the piston surface 4*a* so that the piston surface 4*b* bears directly upon the end of the threaded bolt 3.

A drive means is provided for driving or rotating the nut 8 so as to adjust the distance between the punch P and a press table 16. The drive means includes a rotatable shaft 14 mounted in the punch P which has mounted thereon a gear 13 cooperating with a further gear 13*a* fixedly mounted on one end of a rotatable shaft 13*b* with a further gear 13*c* being provided at the other end of the shaft 13*b* for cooperating with the external toothing 12 of the nut 8.

As shown in FIGS. 2 and 3, a conduit 15 is provided which communicates the pressure space 5 with a pressure medium source (not shown). A conventional control means is operatively connected with the conduit 15 and/or the pressure medium source so as to permit the pressure medium to be fed to the pressure space 5 and also permit a relieving or discharging of the pressure medium from the pressure space 5 through the conduit 15 so as to relieve the pressure in the pressure space 5.

The punch P is arranged in a press above a press table 16 in a conventional manner and the pressure space is relieved or unloaded so as to permit an adjustment of the distance between the punch P and the press table by the drive means rotating or driving the nut 8. Upon a proper adjustment of the punch P, the pressure space 5 is charged or filled with a pressure medium so as to cause the piston surface 4*b* of the piston 4 to bear against the end of the threaded bolt 3, thereby creating a constantly-acting or permanently-acting tension on the adjusting arrangement of the bolt 3 and the nut 8.

FIG. 2 provides an illustration of the positioning of the respective elements when the punch P is adjusted at a maximum distance from the press table with FIG. 3 providing an illustration of an adjustment of the punch P at a minimum distance from the press table. As readily apparent, by adjusting the nut 8, the punch P may be set at any desired position between the two extreme positions shown in FIGS. 2 and 3.

While we have shown and described only one embodiment in accordance with the present invention, it is understood that the same is not limited thereto, but is susceptible of numerous changes and modifications as known to a person skilled in the art, and we therefor do not wish to be limited to the details shown and described herein, but intend to cover all such changes and modifications as are encompassed by the scope of the appended claims.

We claim:

1. A press arrangement comprising:

a press table, a punch means, adjusting means for selectively adjusting a distance between said punch means and said press table including a rotatable threaded nut mounted in said punch means so as to be axially fixed with respect thereto, and a non-rotatable threaded bolt means cooperating with said rotatable threaded nut and mounted in said punch means so as to be axially displaceable therein, connecting means for connecting a first end of said threaded bolt means with a drive element of the press arrangement, and tension creating means arranged in said punch means and cooperating with a second end of said threaded bolt means for selectively creating constantly-acting tension on said adjusting means, said tension creating means including a single pressure space means, provided in said punch means, for selectively receiving a supply of a pressure medium during a pressing operation of said punch means, said pressure space means being selectively relievable in order to release said punch means in event of seizure, and said pressure space means being disposed directly in a path of force transmitting power between said connecting means and a lower portion of said punch means to a workpiece.

2. An arrangement according to claim 1, wherein engaging means arranged in said pressure space means and acted upon by the pressure medium for engaging the second end of said threaded bolt means when the pressure medium is supplied to said pressure space means.

3. An arrangement according to claim 2, wherein said engaging means includes a piston means having a first piston surface facing the second end of said threaded bolt means and a second piston surface facing said pressure space means.

4. An arrangement according to claim 3, wherein said piston means is floatingly disposed in said punch means between said pressure space means and the second end of said threaded bolt means.

5. An arrangement according to claim 3, wherein driving means are provided in said punch means for selectively driving said rotatable threaded nut.

6. An arrangement according to claim 5, wherein said punch means includes a plurality of spaced walls defining a chamber, and wherein said pressure space means includes a pot-shaped cylinder accommodated in said chamber.

7. An arrangement according to claim 6, further comprising a tubular sleeve arranged in said chamber and secured to said punch means, said rotatable threaded nut being arranged between an upper end of said pot-shaped cylinder and a lower end of said tubular sleeve.

8. An arrangement according to claim 7, wherein said rotatable threaded nut includes a toothing on an outer periphery thereof, and wherein said driving means includes gear means cooperating with said toothing so as to selectively rotate said rotatable threaded nut.

* * * * *